US006875291B2

(12) United States Patent
Kanematsu et al.

(10) Patent No.: US 6,875,291 B2
(45) **Date of Patent: *Apr. 5, 2005**

(54) METHOD FOR PRODUCING A TIN-ZINC ALLOY FILM

(75) Inventors: Hideyuki Kanematsu, Suzuka (JP); Tatsumasa Kobayashi, Yokkaichi (JP); Takeo Oki, Tsushima (JP)

(73) Assignee: Susuka National College of Technology, Susuka (JP)

( * ) Notice: Subject to any disclaimer, the term of this patent is extended or adjusted under 35 U.S.C. 154(b) by 156 days.

This patent is subject to a terminal disclaimer.

(21) Appl. No.: 10/145,894

(22) Filed: May 16, 2002

(65) Prior Publication Data

US 2003/0024613 A1 Feb. 6, 2003

(30) Foreign Application Priority Data

Jun. 14, 2001 (JP) ..... 2001-180159

(51) Int. Cl.[7] ..... C23D 18/31; C25D 3/22; C25D 3/30; C25D 5/50

(52) U.S. Cl. ..... 148/512; 427/123; 427/406; 205/225; 205/226; 148/242

(58) Field of Search ..... 205/225, 226; 148/240, 242, 280, 512; 427/123, 406

(56) References Cited

U.S. PATENT DOCUMENTS

| | | | | | |
|---|---|---|---|---|---|
| 4,999,258 | A | * | 3/1991 | Wake et al. | 428/632 |
| 5,985,056 | A | * | 11/1999 | McCay et al. | 148/511 |
| 6,183,886 | B1 | * | 2/2001 | Chen et al. | 205/226 |

FOREIGN PATENT DOCUMENTS

| | | | | |
|---|---|---|---|---|
| JP | A 63-186860 | | 8/1988 | |
| JP | A 63-290292 | | 11/1988 | |
| JP | B2 1-21225 | | 4/1989 | |
| JP | 01165791 A | * | 6/1989 | C25D/5/26 |
| JP | B2 6-53957 | | 7/1994 | |
| JP | A 2001-165791 | | 6/2001 | |

* cited by examiner

*Primary Examiner*—Roy King
*Assistant Examiner*—Harry D. Wilkins, III
(74) *Attorney, Agent, or Firm*—Oliff & Berridge, PLC

(57) ABSTRACT

A tin layer and a zinc layer are stacked sequentially on a given substrate to form a multilayered film composed of the tin layer and the zinc layer. Then, the multilayered film is heated to a given temperature to form a tin-zinc alloy film through the diffusion of the tin elements of the tin layer into the zinc layer.

5 Claims, 4 Drawing Sheets

METHOD FOR PRODUCING A TIN-ZINC ALLOY FILM

BACKGROUND OF THE INVENTION

1. Field of the Invention

This invention relates to a method for producing a tin-zinc alloy film, particularly a method for producing a tin-zinc alloy film for corrosion-resistant purposes.

2. Description of the Prior Art

Recently, an attention has been paid to a tin-zinc alloy film to replace for a corrosion-resistant cadmium plating film. Such a cadmium plating film itself has excellent corrosion-resistance and thus, is employed as a material for an aircraft at present. However, the cadmium plating film is strictly restricted in use because it has harmful element, Cd for environment. In this point of view, the use of the cadmium plating film would be more severely restricted in future. Therefore, the tin-zinc alloy film would play very important roles in future instead of the cadmium plating film.

In the past, the tin-zinc film would be produced from a given water solution by means of alloy-electroplating, and thus, two different metals, tin and zinc, must be electroplated at the same voltage. Therefore, all kinds of things to perform the electroplating at the same voltage have been carried out. Moreover, chemical species to be used have been restricted, and anti-environmental additives have been used.

Furthermore, the above electroplated tin-zinc film from the water solution always has a thermally non-equilibrium phase which is not recognized in its equilibrium diagram. The non-equilibrium phase often shifts to another stable phase due to the wear or the heating in the use of the tin-zinc alloy film, and thus, the properties of the tin-zinc alloy film often change. Therefore, the functions imparted to the tin-zinc alloy film for predetermined purposes may change during the use of the film, so that it may be that the tin-zinc alloy film can not exhibit the predetermined functions in use.

Such a technique is described in Japanese Patent Application Laid-open No. 01-165791 as plating a zinc film and a tin film in their respective predetermined thickness on a given steel plate and then, melting the tin film and diffusing the tin elements into the zinc film through a given thermal treatment, to produce a tin-zinc alloy film. With such a technique, however, the tin elements and the zinc elements are inclined in the tin-zinc alloy film in concentration, so that the tin elements and the zinc elements can not be alloyed perfectly. Therefore, the imperfect tin-zinc alloy film may change in property, and thus, can not exhibit their functions imparted in advance sufficiently.

SUMMARY OF THE INVENTION

It is an object of the present invention to provide a method for producing a stable tin-zinc alloy where the tin elements and the zinc elements are perfectly alloyed and the predetermined functions such as corrosion-resistance can be exhibited sufficiently.

For achieving the above object, this invention relates to a method for producing a tin-zinc alloy film comprising the steps of:

depositing a tin layer and a zinc layer on a given substrate sequentially, thereby to form a multilayered film composed of the tin layer and the zinc layer, and heating the multilayered film at a given temperature to produce a tin-zinc alloy film.

The inventors had intensely studied to alloy tin elements and zinc elements perfectly, to obtain a uniform and stable tin-zinc alloy film. As a result, they found out that a tin film and a zinc film which includes the tin elements and the zinc elements are stack, and then, the thus obtained multilayered film is heated up to a given temperature, to alloy the tin elements and the zinc elements perfectly through the inter-diffusion and produce a tin-zinc alloy film desired which can exhibit excellent corrosion-resistance in use for a long time.

That is, according to the present invention, the tin-zinc alloy film is produced indirectly through the inter-diffusion between the tin elements and the zinc elements.

In this way, since the tin-zinc alloy film is produced through the inter-diffusion between the tin elements and the zinc elements by means of thermal treatment, if a thermally non-equilibrium phase is created, the non-equilibrium phase is shifted to a stable phase through the thermal diffusion process. Therefore, since the tin-zinc alloy film does not include a non-equilibrium phase, different from a conventional tin-zinc alloy film produced by means of electroplating, the properties does not almost change in use. As a result, functions such as corrosion-resistance which are imparted to the tin-zinc alloy film in advance can be maintained in use for a long time.

Also, since in the tin-zinc alloy film of the present invention, the tin elements and the zinc elements are perfectly alloyed by controlling the interdiffusion temperature and the inter-diffusion period of time, the composition of tin-zinc alloy film does not almost change. In this point of view, the functions such as corrosion-resistance imparted in advance can be maintained for a long time.

BRIEF DESCRIPTION OF THE DRAWINGS

For better understanding of the present invention, reference is made to the attached drawings, wherein.

DESCRIPTION OF THE PREFERRED EMBODIMENTS

Figure 1:
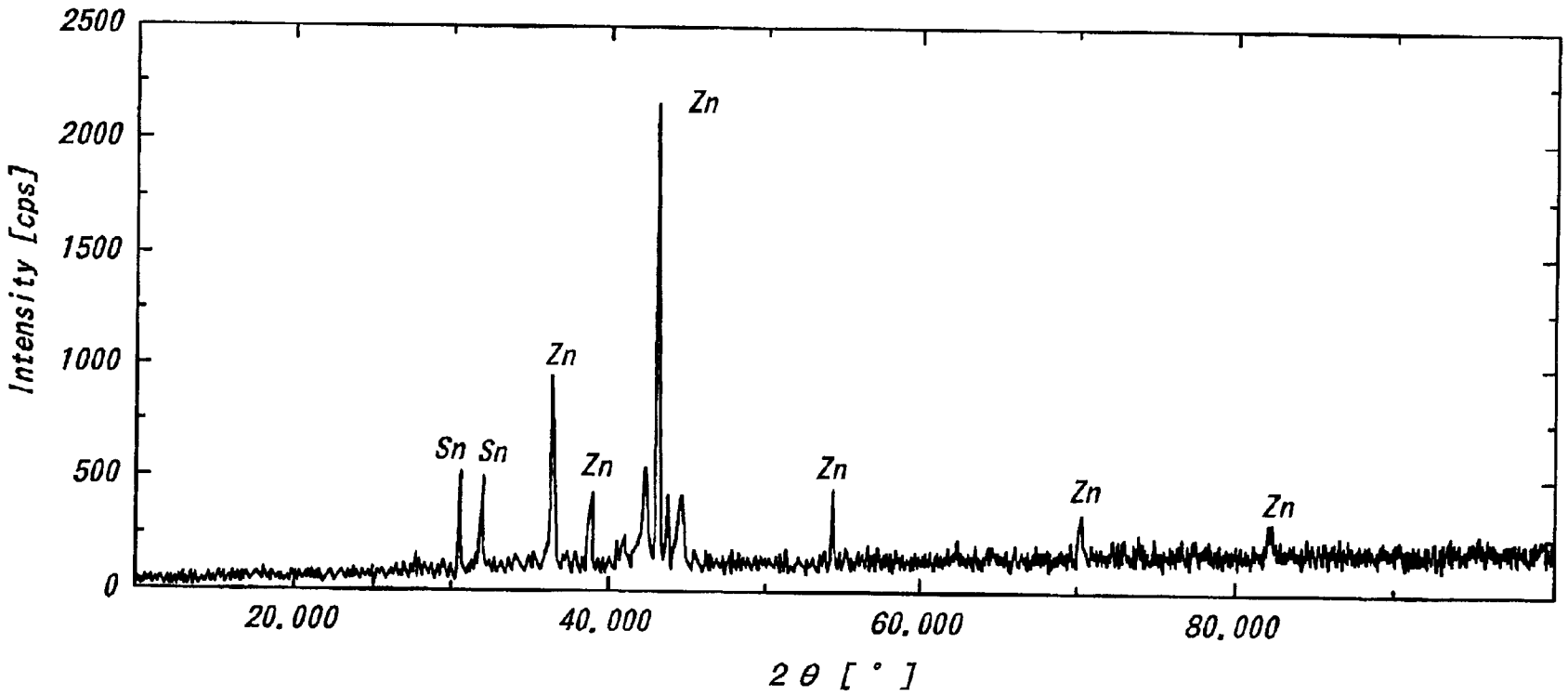
FIG. 1 is a X-ray diffraction profile of a tin-zinc alloy film obtained by the producing method of the present invention.

This invention will be described in detail by way of examples with reference to the accompanying drawings.

In the present invention, it is required that a multilayered film composed of a tin layer and a zinc layer is formed and heated to a given temperature. The heating process is preferably carried out at a temperature not less than the melting point of tin. In this case, since the tin layer is melted, and the thus obtained liquid tin diffuses fast into the zinc layer, the tin-zinc alloy film can be produced simply in a shorter time.

For example, although it takes several hours in the heating process at a temperature not less than the melting point of tin, it takes several days in the heating process at a temperature less than the melting point of tin.

Moreover, the upper limited temperature in the heating process is not particularly restricted, and is determined on the properties of a whole control system or a furnace for the heating process. Generally, the upper limited temperature is about 400° C. Even though the heating process is carried out at a temperature more than the upper limited temperature, it can not almost improve the properties of the thus obtained tin-zinc alloy film. Herein, the melting point of tin is about 232° C.

Moreover, the stacking order of the tin layer and the zinc layer in the multilayered film is not particularly restricted, but it is desired to stack the zinc layer and the tin layer in turn.

In the case of forming the zinc layer on the tin layer to form the multilayered film, first, the tin layer is electroplated on a given substrate, and thereafter, the zinc layer is formed from a strong acidic bath such as a zinc sulfate bath. Therefore, the tin layer is immersed into the strong acidic bath for a long period of time during the formation of the zinc layer. As a result, the tin layer is partially melted and reduced in its thickness.

Therefore, the tin content of the thus obtained tin-zinc alloy film is decreased and the sort of stable phase is restricted. Therefore, for producing a tin-zinc alloy film so as to include a desired tin content, it is required that the tin layer is formed thicker so as to compensate the thickness of the tin layer to be reduced.

In this point of view, if the zinc layer and the tin layer are formed in turn as mentioned above, the tin layer can be simply formed without the compensation of the thickness to be reduced by the strong acidic bath.

Moreover, it is preferable that the thickness of the tin layer is set within 10–50 μm, and the thickness of the zinc layer is set within 10–50 μm. In this case, the tin-zinc alloy film obtained through the subsequent heating process can have various stable phases. Also, if the tin layer and the zinc layer have the above thickness, the fluctuation margin in the electroplating condition for forming the above tin layer and zinc layer is allowable to some degree. That is, even though the electroplating condition for forming the tin layer and the zinc layer is fluctuated slightly, the tin layer and the zinc layer can have thickness within the above thickness range, respectively.

Although the tin layer and the zinc layer are deposited on a given substrate, the depositing means is not particularly restricted. However, the tin layer and the zinc layer are preferably electroplated on the given substrate because the electroplating can form the layers thicker in a relatively short period of time and the operationality of the electroplating is easy.

In forming the tin layer by the electroplating method, an electroplating bath such as an acidic bath or an alkaline bath may be used. A sulfuric acid bath, a methanosulfonic acid bath or a tetrafluoroboric acid bath may be exemplified as the acidic bath. In forming the zinc layer by the electroplating method, an electroplating bath mainly including zinc sulfate and/or zinc chloride may be employed.

Through the above process according to the present invention, the tinzinc alloy film, which does not include a non-equilibrium phase and in which the tin elements and the zinc elements are perfectly alloyed, can be obtained. Then, the alloy film has preferably at least one of solid solution and eutectic alloy of tin and zinc. In this case, the properties of the alloy film, that is, the functions imparted to the alloy film can be maintained for a long time.

EXAMPLES

This invention is concretely described on the following examples, but is not restricted to the examples.

Example 1

A pure iron plate having a thickness of 2 mm was used as a substrate, and then, was immersed into a fluoroboric acid bath having a total amount of 300 ml which included 18 ml of 42%-boric hydrofluoric acid, 2 ml of 44.6%-fluoroboric tin and 15 mg of polyethylene glycol (molecular weight=2000). Then, the fluoroboric acidic bath was electrolyzed by flowing a current at a current density of 1 A/dm$^2$ for five minutes to form a tin layer in a thickness of 30 μm on the iron plate.

Then, the iron plate having the tin layer thereon was immersed into a zinc plating bath having a total amount of 300 ml which included 137 g of zinc chloride, 10 g of boric acid, 5 g of natrium chloride and 10 g of aluminum sulfate and which was heated to 40° C. Then, the zinc plating bath was electrolyzed by flowing a current at a current density of 20 A/dm$^2$ for five minutes to form a zinc layer in a thickness of 30 μm on the tin layer, to fabricate a multilayered film composed of the tin layer and the zinc layer. During the formation of the zinc layer, it was recognized that the thickness of the tin layer was reduced up to several μm.

Figure 2:
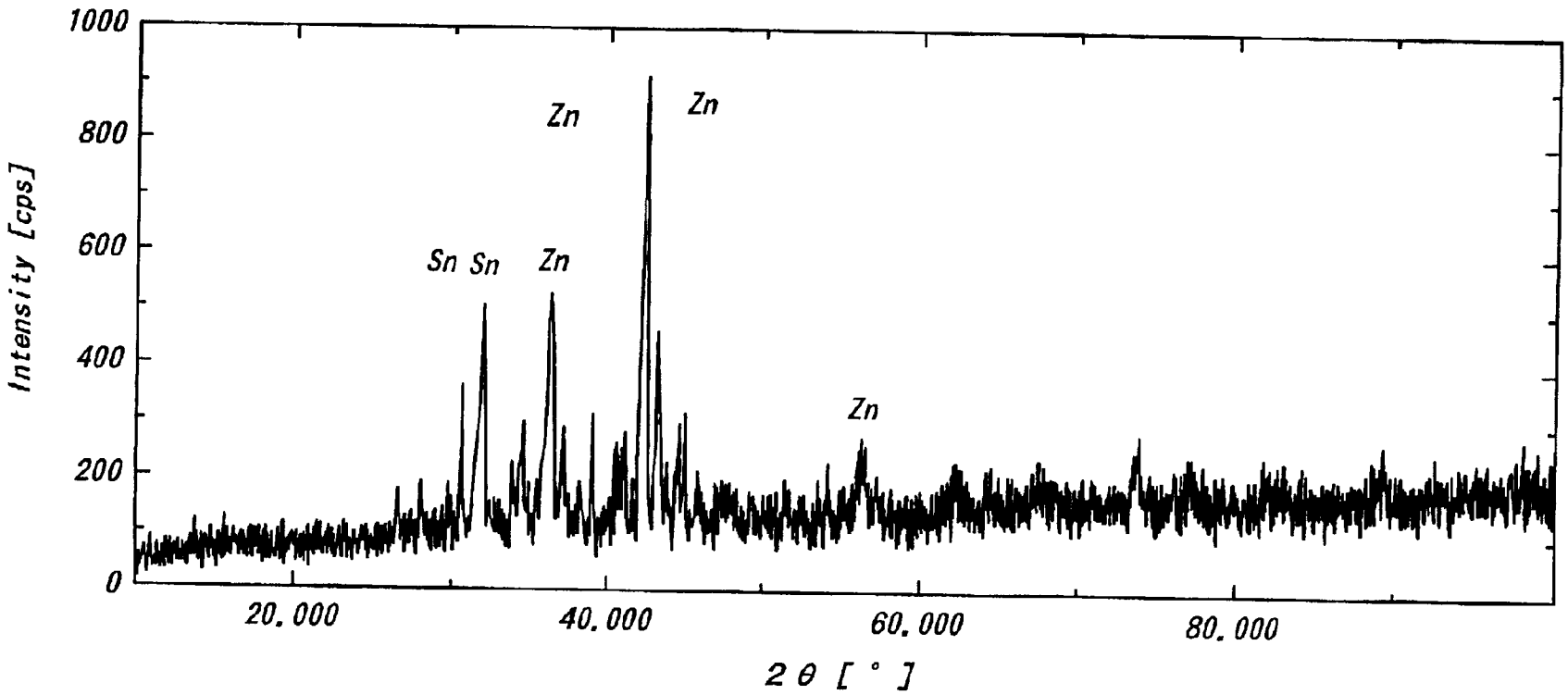
FIG. 2 is another X-ray diffraction profile of a tin-zinc alloy film obtained by the producing method of the present invention.

Then, the iron plate having the above multilayered film was set into an electric furnace, and heated at 350° C. and 450° C. for three hours, respectively. As a result, the tin layer disappeared perfectly at both temperatures and it was turned out that the tin elements diffused into the zinc layer. FIG. 1 is a X-ray diffraction profile of the tin-zinc alloy film obtained through the thermal treatment at 350° C., and FIG. 2 is a X-ray diffraction profile of the tin-zinc alloy film obtained through the thermal treatment at 450° C. As is apparent from FIGS. 1 and 2, since only the diffraction peaks relating to tin and zinc are observed and diffraction peaks relating to tin-zinc alloy are not observed, it is turned out that a mixed crystal composed of tin-zinc solid solution and tin-zinc eutectic crystal is created in the tin-zinc alloy film.

Example 2

A pure iron plate having a thickness of 2 mm was used as a substrate, and then, was immersed into a zinc plating bath having a total amount of 300 ml which included 137 g of zinc chloride, 10 g of boric acid, 5 g of natrium chloride and 10 g of aluminum sulfate. Then, the zinc plating bath was electrolyzed by flowing a current at a current density of 20 A/dm$^2$ for five minutes to form a zinc layer in a thickness of 50 μm on the iron plate.

Then, the iron plate having the zinc layer thereon was immersed into a fluoroboric acid bath having a total amount of 300 ml which included 18 ml of 42%-boric hydrofluoric acid, 2 ml of 44.6%-fluoroboric tin and 15 mg of polyethylene glycol (molecular weight=2000). Then, the fluoroboric acidic bath was electrolyzed by flowing a current at a current density of 1 A/dm$^2$ for five minutes to form a tin layer in a thickness of 30 μm on the zinc layer, to fabricate a multilayered film composed of the zinc layer and the tin layer.

Then, the iron plate having the above multilayered film was set into an electric furnace, and heated at 350° C. and 450° C. for three hours, respectively. As a result, the tin layer disappeared perfectly at both temperatures and it was turned out that the tin elements diffused into the zinc layer.

Figure 3:
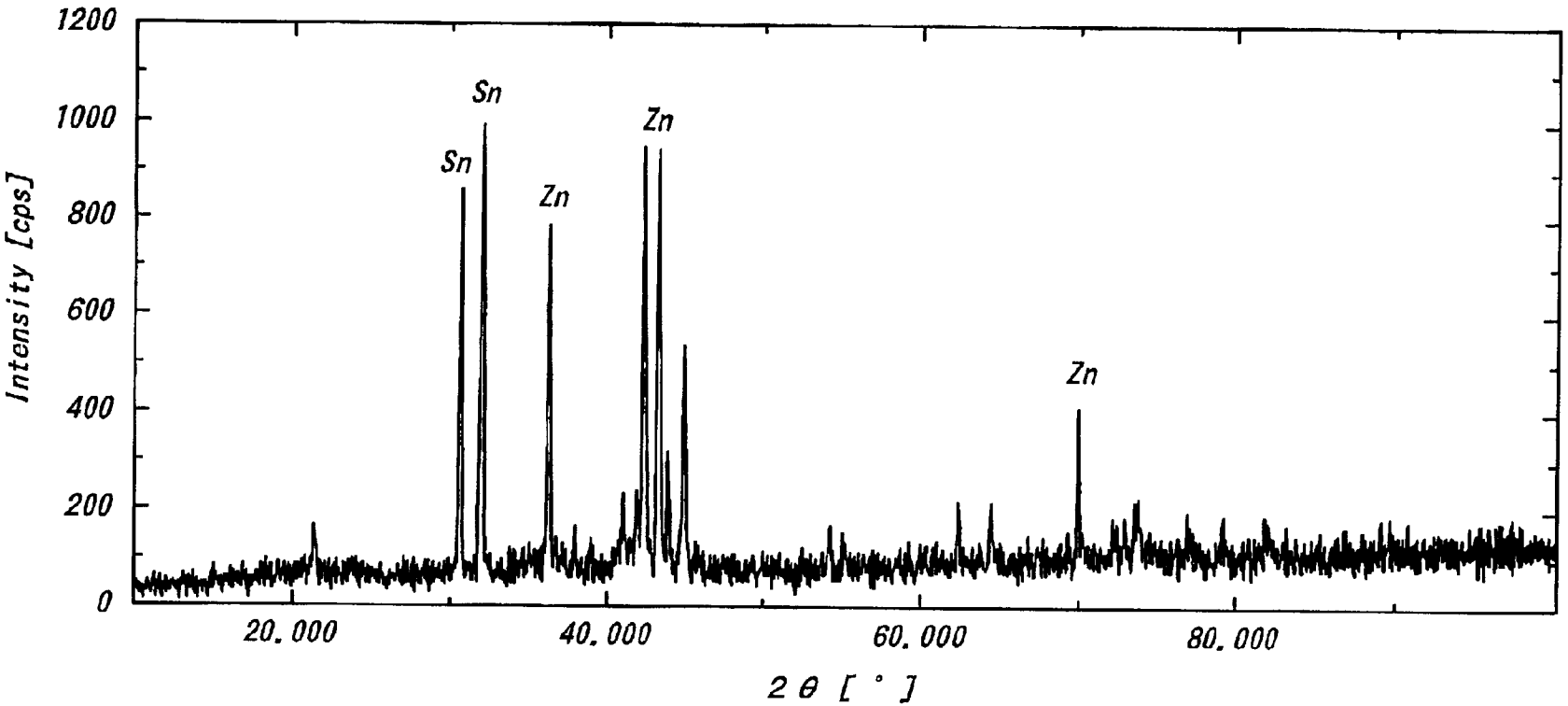
FIG. 3 is still another X-ray diffraction profile of a tin-zinc alloy film obtained by the producing method of the present invention.
Figure 4:
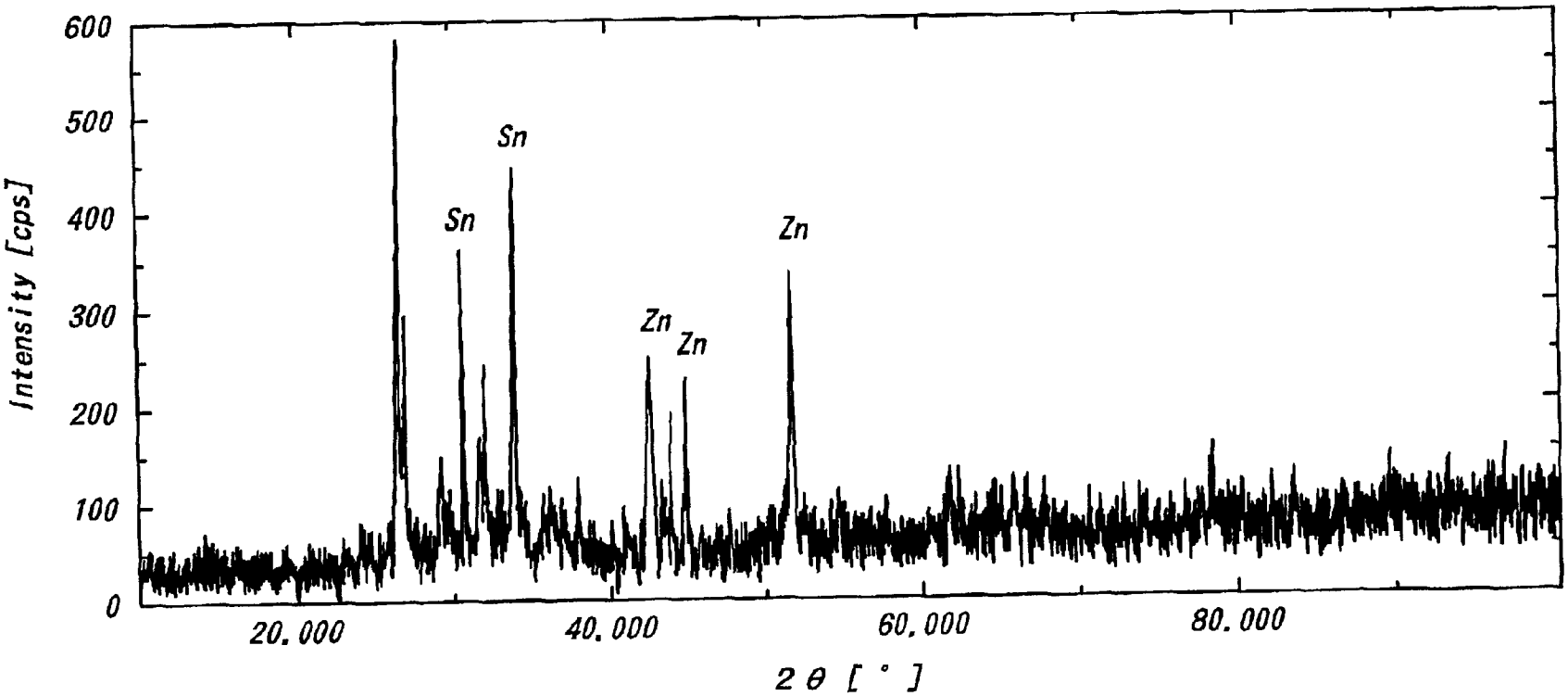
FIG. 4 is a further X-ray diffraction profile of a tin-zinc alloy film obtained by the producing method of the present invention.

FIG. 3 is a X-ray diffraction profile of the tin-zinc alloy film obtained through the thermal treatment at 350° C., and FIG. 4 is a X-ray diffraction profile of the tin-zinc alloy film obtained through the thermal treatment at 450° C. As is apparent from FIGS. 3 and 4, since only the diffraction peaks relating to tin and zinc are observed and diffraction peaks relating to tin-zinc alloy are not observed, it is turned out that a mixed crystal composed of tin-zinc solid solution and tin-zinc eutectic crystal is created in the tin-zinc alloy film.

Although the present invention was described in detail with reference to the above examples, this invention is not limited to the above disclosure and every kind of variation and modification may be made without departing from the scope of the present invention.

As is explained above, according to the present invention, a tin-zinc alloy film, which does not include unstable phase and in which the tin elements and the zinc elements are perfectly alloyed, can be provided. Therefore, the change in property of the alloy film can be repressed regardless of the wear and the heating in use. As a result, the functions imparted to the alloy film in advance can be maintained for a long time.

What is claimed is:

1. A method for producing a tin-zinc alloy film comprising the steps of:

depositing a tin layer and a zinc layer on a substrate sequentially to form a multilayered film composed of said tin layer and said zinc layer, wherein the tin layer and the zinc layer each have a thickness within a range of 10 $\mu$m to 50 $\mu$m and heating said multilayered film at a given temperature to produce a uniform tin-zinc alloy film.

2. The method of claim 1, wherein the heating process is carried out at a temperature not less than the melting point of tin.

3. The method of claim 1, wherein in said multilayered film, said tin layer is stacked on said zinc layer.

4. The method of claim 1, wherein said tin layer and said zinc layer are deposited by an electroplating method.

5. The method of claim 1, wherein said tin-zinc alloy film includes at least one of solid solution and eutectic alloy made of tin and zinc.

* * * * *